US008770992B2

(12) United States Patent
Yu et al.

(10) Patent No.: US 8,770,992 B2
(45) Date of Patent: Jul. 8, 2014

(54) LEAKAGE CURRENT DETECTION INTERRUPTER PLUG HAVING DETACHABLE CONNECT TERMINALS

(75) Inventors: Andy Yu, Shenzhen (CN); Ji Han, Shenzhen (CN); Chepur P. Rao, Providence, RI (US); Victor V. Aromin, Providence, RI (US)

(73) Assignee: Tower Manufacturing Corporation, Providence, RI (US)

( * ) Notice: Subject to any disclaimer, the term of this patent is extended or adjusted under 35 U.S.C. 154(b) by 0 days.

(21) Appl. No.: 13/559,100

(22) Filed: Jul. 26, 2012

(65) Prior Publication Data

US 2013/0330939 A1 Dec. 12, 2013

(51) Int. Cl.
*H01R 13/514* (2006.01)

(52) U.S. Cl.
USPC ..... 439/76.2; 439/76.1

(58) Field of Classification Search
USPC ..... 439/76.1, 76.2, 176, 651, 692, 697
See application file for complete search history.

(56) References Cited

U.S. PATENT DOCUMENTS

| | | | | | |
|---|---|---|---|---|---|
| 3,050,706 | A * | 8/1962 | Kitscha | 439/781 |
| 3,340,497 | A * | 9/1967 | Balint | 439/872 |
| 4,174,147 | A * | 11/1979 | Waddington et al. | 439/636 |
| 4,210,379 | A * | 7/1980 | Vachhani et al. | 439/406 |
| 4,451,102 | A * | 5/1984 | Reh | 439/266 |
| 5,310,352 | A * | 5/1994 | Mroczkowski et al. | 439/76.1 |
| 6,998,945 | B2 * | 2/2006 | Huang et al. | 335/18 |
| 7,422,452 | B2 * | 9/2008 | Achtner et al. | 439/106 |
| 8,096,813 | B2 * | 1/2012 | Biggs | 439/76.1 |
| 8,137,115 | B1 * | 3/2012 | Chou et al. | 439/76.1 |
| 8,197,265 | B1 * | 6/2012 | Lee et al. | 439/105 |
| 8,432,699 | B2 * | 4/2013 | Chou et al. | 361/730 |
| 2009/0209117 | A1 * | 8/2009 | Polehonki et al. | 439/76.2 |

* cited by examiner

*Primary Examiner* — James Harvey
(74) *Attorney, Agent, or Firm* — Muncy, Geissler, Olds & Lowe, P.C.

(57) ABSTRACT

An electric plug includes an end block and a power cord. The end block includes a plurality of first connectors and the power cord includes a plurality of second connectors which correspond to the first connectors and detachably connected thereto. The first connectors and second connectors are electrically conductive. One or more first connectors are connected to the second connectors by press-fitting and are retained therewith by friction. Alternatively, the first connectors may be a terminal screw assembly and the second connectors are wires of the power cord.

12 Claims, 12 Drawing Sheets

LEAKAGE CURRENT DETECTION INTERRUPTER PLUG HAVING DETACHABLE CONNECT TERMINALS

This nonprovisional application claims priority under 35 U.S.C. §119(a) to Chinese Patent Application No. 201220263720.3, which was filed in China on Jun. 6, 2012, and which is herein incorporated by reference.

BACKGROUND OF THE INVENTION

1. Field of the Invention

The present invention relates generally to an electric plug, and particularly to a Leakage Current Detection Interrupter (LCDI) plug having detachable connect terminals.

2. Description of the Background Art

Electric wires are usually fixedly connected to the terminals of an electric plug, such as a leakage current detection interrupter plug, by soldering. However, a manufacturing process using soldering is inefficient and requires special soldering tools and skill. Once the power cord is connected to the terminals of the end block of the electric plug by solder, the power cord can no longer be detached from the end block of the electric plug. If either the power cord or the end block of the electric plug is damaged, the entire product, including the undamaged parts, will have to be discarded.

Therefore, it is desirable to produce an electric plug having quick detachable connect terminals whereby the power cord can be detachably connected to the end block of the electric plug such that the end block of the electric plug or the power cord can be manufactured separately. It is also desirable that the power cord and the end block of the electric plug can be replaced individually.

SUMMARY OF THE INVENTION

According to one aspect of the invention, there is provided an electric plug including an end block and a power cord. The end block includes a plurality of first connectors and the power cord includes a plurality of second connectors which are corresponding to the first connectors and detachably connected thereto. The first connectors and second connectors are electrically conductive. One or more first connectors are detachably connected to the second connectors by press-fitting and are retained therewith by friction, or by terminal screws, or other means of detachable connection.

In one embodiment, one of the first connectors is an electric contact formed on a circuit board inside the end block, and one of the second connectors is a flexible metal leaf spring which is urged by a spring force against the electric contact on the circuit board upon coming into connection with the electric contact. In case of a leakage current detection interrupter plug, the circuit board includes a leakage current detection interrupter circuit.

The metal leaf spring has a vertical portion including a slit for frictionally holding therein an end of a first bundle of conductive wires of the power cord, and a horizontal portion having an end adapted to urge against the electric contact on the circuit board. The slit has a closed end, a flared open end and an intermediate section. The intermediate section may be tapering towards the flared open end. The vertical portion of the metal leaf spring includes at least one pair of projections formed on two opposite sides thereof for frictional engagement with two opposite inner sides of a slot formed on the end block.

In another embodiment, at least one of the first connectors is a metal plate connected to a prong mounted on the end block, and at least one of the second connectors is a metal clip which is frictionally retained with the metal plate upon press-fitted therein. In a 3-prong plug, three metal plates are connected respectively to three prongs mounted on the end block, and three metal clips are connected to neutral, live and earth conductive wires of the power cord respectively.

The metal clip includes a proximal portion and a distal portion. The proximal portion includes first and second arms. The first arm is curled up to form a first grip for gripping an insulated end of a second bundle of conductive wires of the power cord. The second arm is curled up to form a second grip for gripping and electrically coupling to a bared conductive end of the second bundle of conductive wires of the power cord. The distal portion includes a base with first and second tabs extending oppositely therefrom and curled up over the base to form a receptacle for frictionally retaining therein the metal plate. The first and second tabs each being curled up into an inverted U-shape in cross section and forming two edges facing the base for frictionally engagement with the metal plate when it is inserted into the receptacle. A free end of the second arm is provided with a finger such that, when the second arm is curled up, the finger can be inserted through an aperture formed on the proximal portion of the metal clip and bent over a lower surface thereof. The proximal portion of the metal clip may be formed with a pair of outwardly bending lugs for holding two opposite sides of the bent over finger respectively.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
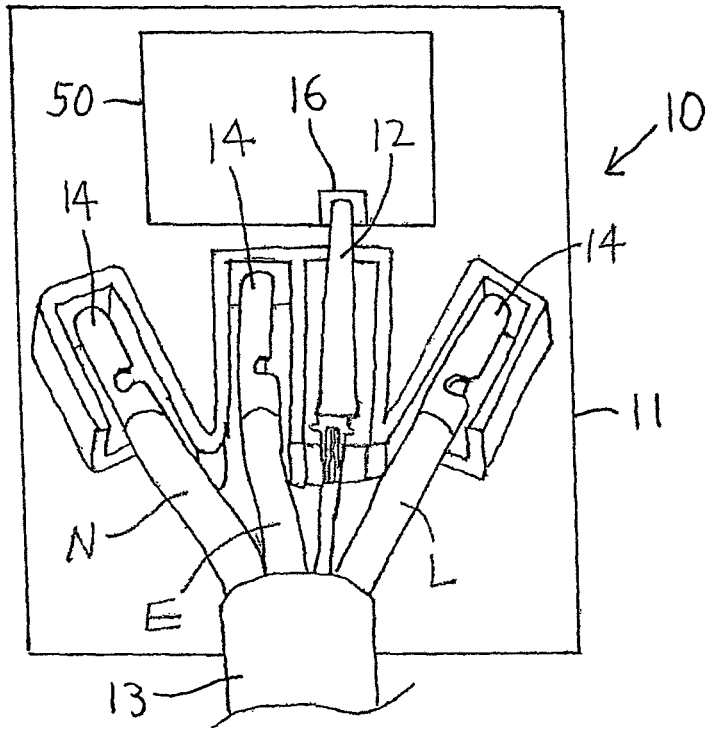
FIG. 1 is a perspective view of the detachable connect terminals of an electric plug according to one embodiment of the present invention.
Figure 1A:
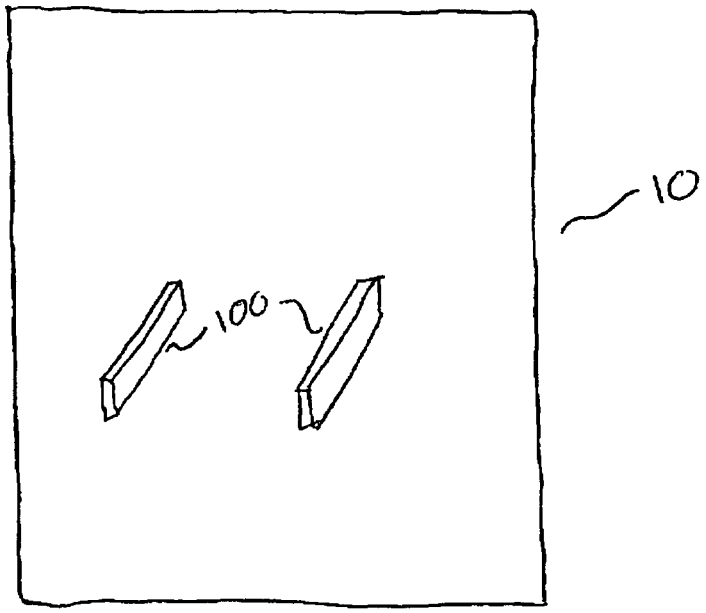
FIG. 1*a* is a perspective view of the electric plug illustrating a plurality of prongs.

FIG. 1 is a perspective view of the detachable connect terminals of an electric plug 10, such as a Leakage Current Detection Interrupter (LCDI) plug, according to one embodiment of the present invention. The electric plug 10 includes an end block 11 and a power cord 13. The end block 11 is a housing, usually made of plastic, for accommodating therein terminals of the electric plug 10. A plurality of prongs 100, as illustrated in FIG. 1*a*, is extended outwardly from one side of the end block 11 for connecting the electric plug 10 to a power outlet.

The end block 11 includes a plurality of first connectors 16, 18, and the power cord 13 includes a plurality of second connectors 12, 14 which correspond to the first connectors and detachably connected thereto. The first connectors 16, 18 and the second connectors 12, 14 are made of electrically conductive material. One or more first connectors are connected to the second connectors by press-fitting and are retained therewith by friction.

Figure 2:
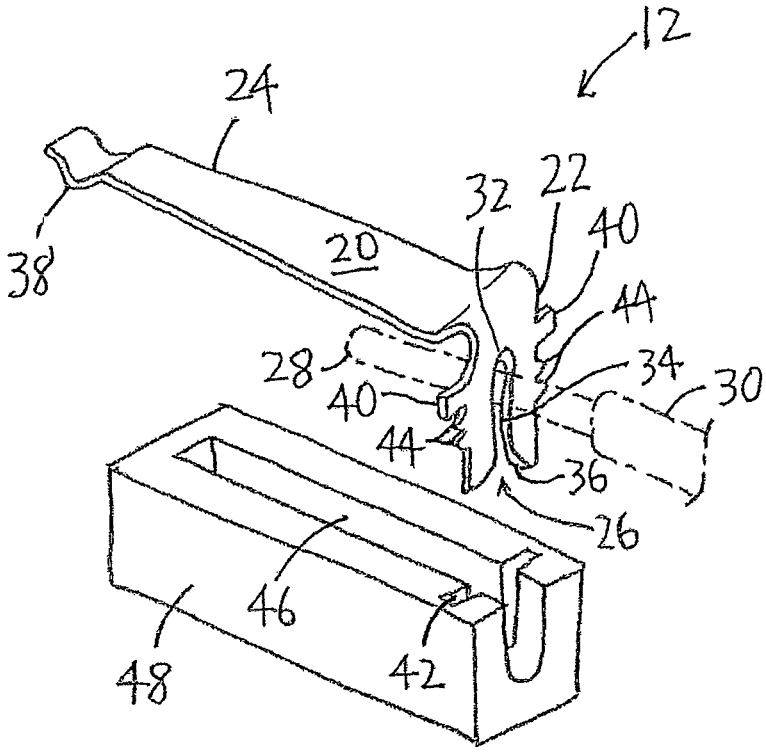
FIG. 2 is an exploded view of a first detachable connect terminal according to one embodiment of the present invention.

As shown in FIG. 2, one of the second connectors may be in the form of a quick connect metal leaf spring 12 having a vertical portion 22 and a horizontal portion 24. The vertical portion 22 includes a slit 26 for frictionally holding therein a first bundle of conductive wires 28 of an insulated wire 30 of the power cord 13, shown by phantom lines. The slit 26 has a closed end 32, a flared open end 36 and an intermediate section 34. The width of the slit 26 is smaller than the width of the first bundle of conductive wires 28. The intermediate section 34 may be tapered towards the flared open end 36.

To insert the conductive wires 28 into the slit 26, one has to strip the insulation layer from one end of the insulated wire 30 so that a first bundle of conductive wires 28 can be exposed from the end of the insulated wire 30. The first bundle of conductive wires 28 is positioned at the flared open end 36 of the slit 26. The first bundle of conductive wires 28 is then forced into the closed end 32 of the slit 26 through the intermediate section 34. Since the width of the slit 26 is smaller than the width of the first bundle of conductive wires 28, the first bundle of conductive wires 28 can be frictionally held in the slit 26.

The vertical portion 22 of the leaf spring 12 includes a pair of upper projections 40 formed on two opposite sides thereof for positioning the vertical portion 22 inside a transverse slot 42 formed on an elongated wire compartment 48 inside the end block 11. The vertical portion 22 further includes at least one pair of lower projections 44 formed on the two opposite sides thereof for frictionally engagement with two opposite inner sides of the slot 42.

It can be seen that the first bundle of conductive wires 28 is frictionally held at the closed end 32 of the slit 26 in a position generally perpendicular to the plane of the vertical portion 22 such that the first bundle of conductive wires 28 is receivable in a longitudinal groove 46 defined by the elongated wire compartment 48.

The horizontal portion 24 of the metal leaf spring 12 has an end 38 adapted to urge against an electric contact 16 of a circuit on a circuit board 50 by spring force upon coming into connection with the electric contact 16. In a leakage current detection interrupter plug, the circuit board 50 includes a leakage current detection interrupter circuit. The vertical portion 22 may be generally perpendicular to the horizontal portion 24 so that the metal leaf spring 12 is generally L-shape in cross section.

It is appreciated that the metal leaf spring 12 can be easily and quickly press-fitted into the slot 42 thereby connecting the metal leaf spring 12 to the electric contact 16 on the circuit board 50.

Figure 3:
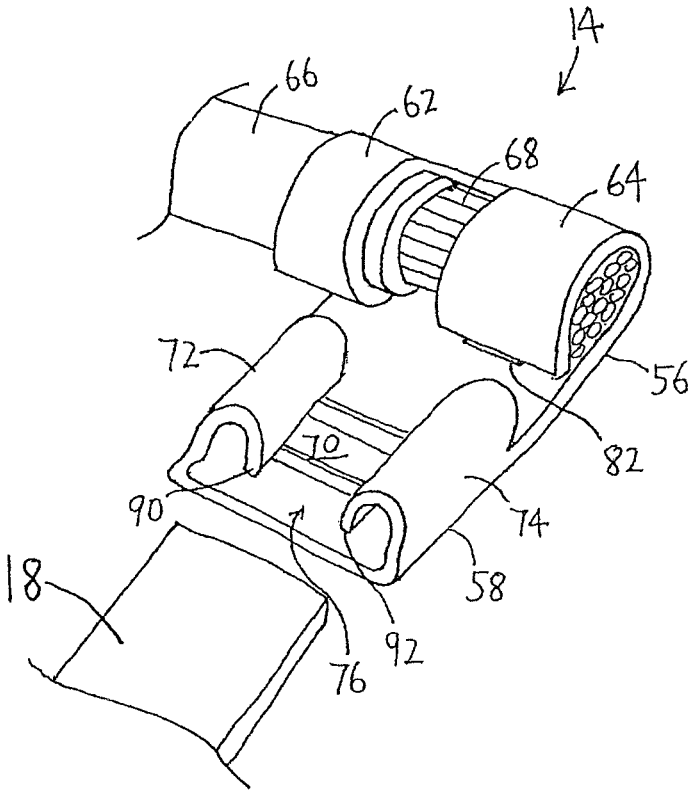
FIG. 3 is a front perspective view of a second detachable connect terminal according to one embodiment of the present invention.
Figure 4:
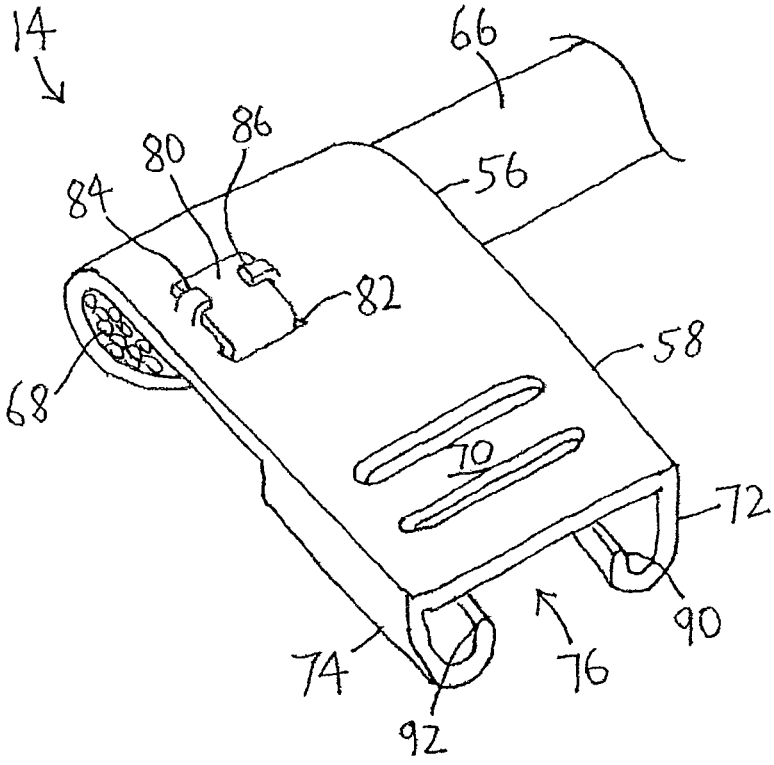
FIG. 4 is a rear perspective view of the second detachable connect terminal of FIG. 3.
Figure 5:
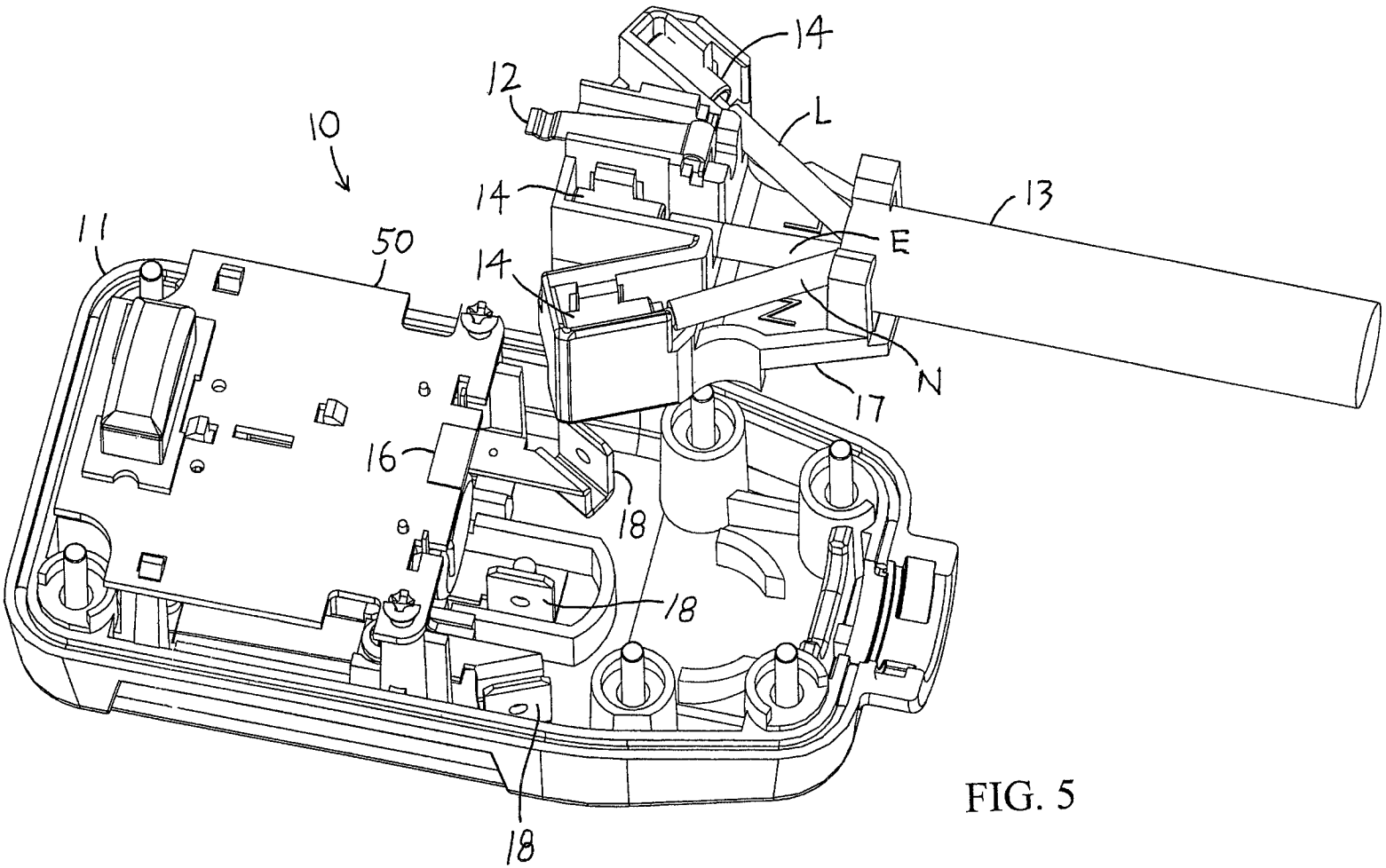
FIG. 5 is an exploded view showing the assembly of the quick connect terminal in an end box of the electric plug according to an embodiment of the present invention.
Figure 6:
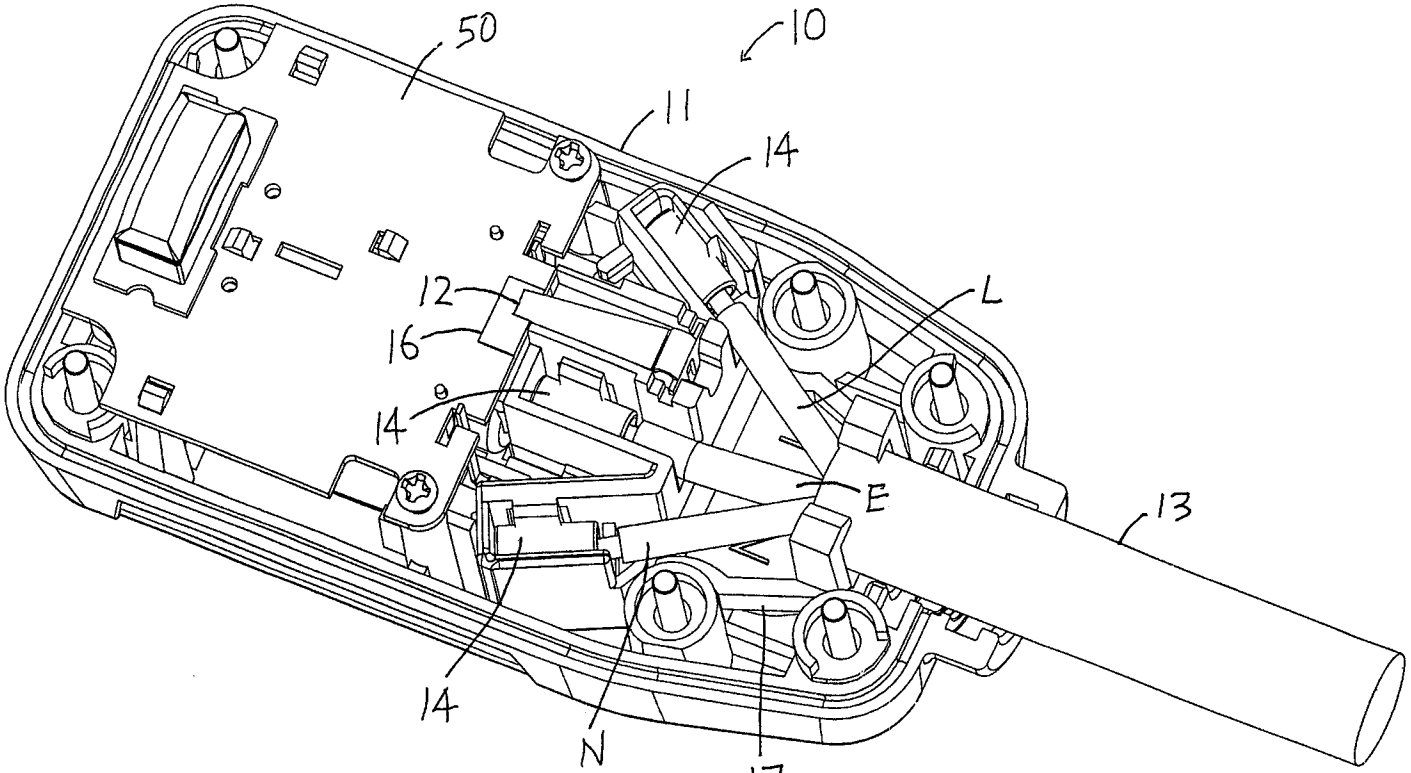
FIG. 6 is a perspective view of the assembled quick connect terminals in the end box of the electric plug.
Figure 7:
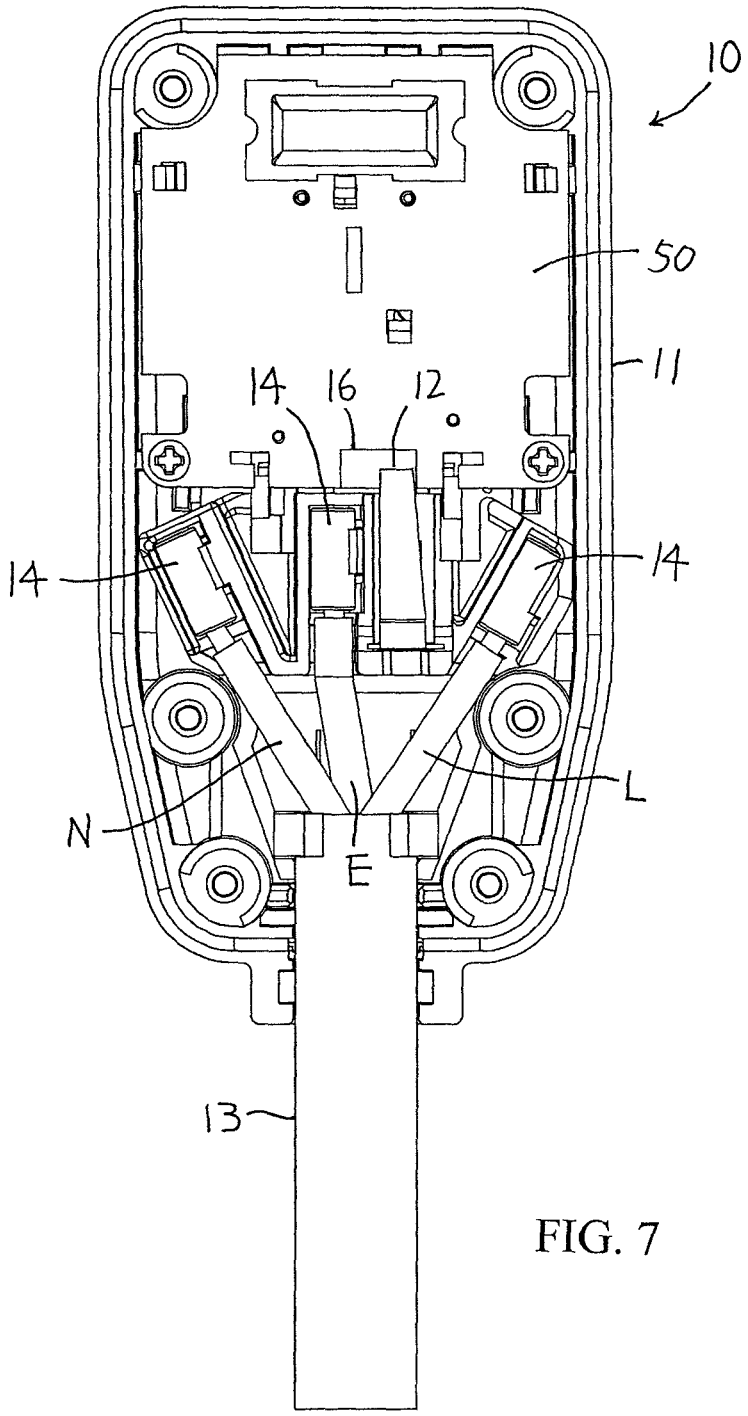
FIG. 7 is a top view of the assembled quick connect terminals shown in FIG. 6.
Figure 8:
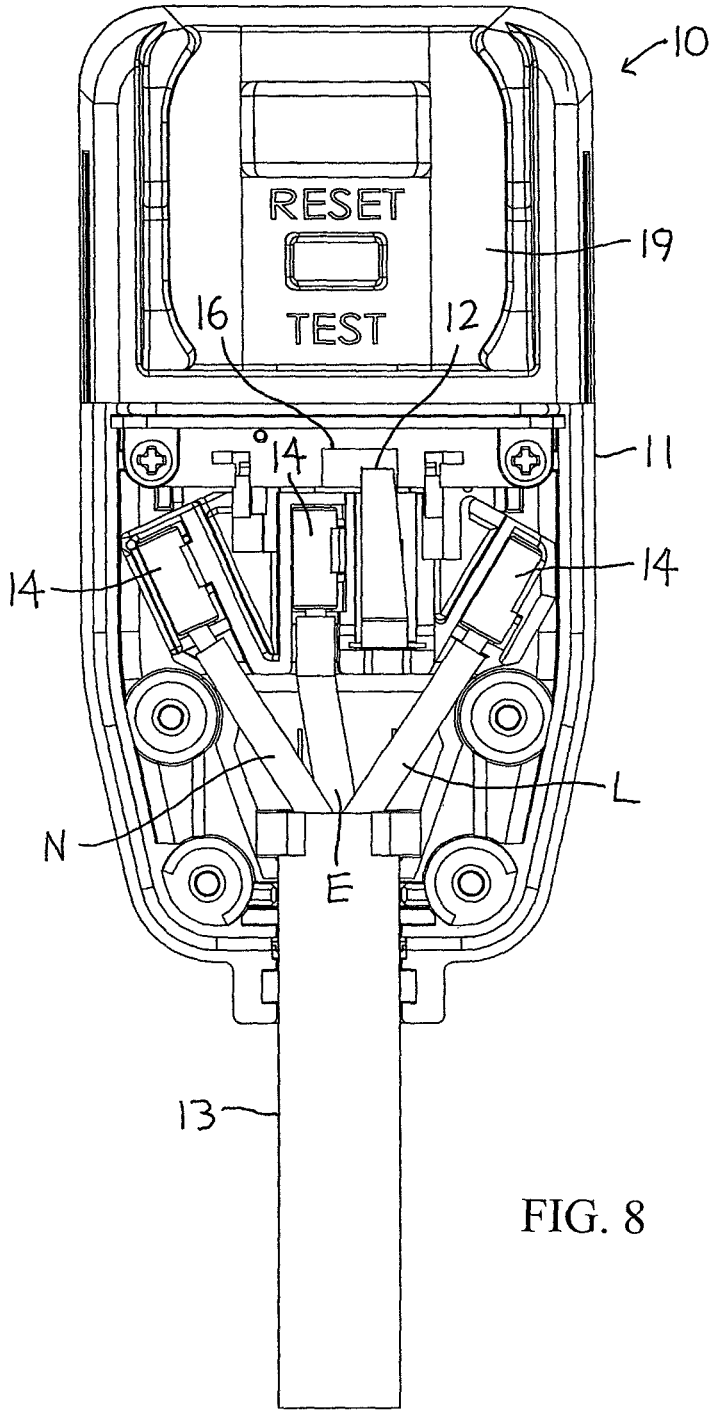
FIG. 8 is a top view of the assembled quick connect terminals shown in FIG. 6 with a partially cut away top cover mounted thereon.

According to the illustrated embodiment, the electric plug 10 further includes three other connectors each being in the form of a quick connect metal clip 14. As depicted in FIGS. 3 and 4, each metal clip 14 can be made from a metal sheet having two portions, namely a proximal portion 56 and a distal portion 58. The proximal portion 56 has first and second arms 62, 64. The first arm 62 can be curled up to form a first grip for gripping an end of another insulated wire 66 of the power cord 13. The second arm 64 can be curled up to form a second grip for gripping and electrically coupling to a second bundle of conductive wires 68 of the insulated wire 66.

A free end of the second arm 64 can be formed with a finger 80 such that, when the second arm 64 is curled up, the finger 80 can be inserted through an aperture 82 formed on the proximal portion 56 and bent over a lower surface thereof. The proximal portion 56 may be formed with a pair of outwardly bending lugs 84, 86 for holding two opposite sides of the bent over finger 80 respectively.

The distal portion 58 has a base 70 with first and second tabs 72, 74 extending oppositely therefrom and curled up over the base 70 to form a receptacle 76 for frictionally retaining therein a metal plate 18. The metal plate 18 is connected to a prong mounted on the end block 11. Each of the first and second tabs 72, 74 can be curled up into an inverted U-shape in cross section and forming two edges 90, 92 facing the base 70 for frictional engagement with the metal plate 18 when it is inserted into the receptacle 76. The metal plate 18 can therefore be retained in the metal clip 14 by frictional force upon press-fitted therein.

A leakage current detection interrupter plug can utilize the quick connect terminals of the present invention to increase the manufacturing efficiency as well as the quality of the product. Referring back to FIG. 1, the metal leaf spring 12 can urge against the electric contact 16 of a leakage current detection interrupter circuit board mounted inside the leakage current detection interrupter plug. Three metal clips 14 can be used to connect the neutral N, live L and earth E wires of the power cord 13 to the three prongs of a 3-prong plug through the connection of the three metal plates 18.

With the electric plugs of the present invention, the end block 11 of the electric plug 10 and the power cord 13 can be manufactured separately in separate manufacturing lines. Once separately manufactured, the end block 11 of the electric plug 10 can be connected to the power cord 13 by simply press-fitting the metal leaf spring 12 into the slot 42 and then press-fitting three metal clips 14 to three metal plates 18. The press-fitting process can be performed by simple tools or even by bare hands. Once connected, all of the connected parts can be securely held in position by frictional force. Hence, the manufacturing process of electric plugs can become simple, quick and efficient. There is no need to use the conventional soldering tools and no skillful workers are required to carry out the rather complicated and laborious soldering process.

FIGS. 5-8 show the assembly of the quick connect terminals of the electric plug 10 according to an embodiment of the present invention. According to the illustrated embodiment, the plurality of second connectors 12, 14 may be mounted on a housing 17 and can be quickly connected to the plurality of first connectors 16, 18 in the end box 11 respectively by press-fitting. The assembled quick connect terminals 12, 14, 16, 18 in the end box 11 can then be covered by a top cover 19 (partially cut away) to form the final product.

Figure 9:
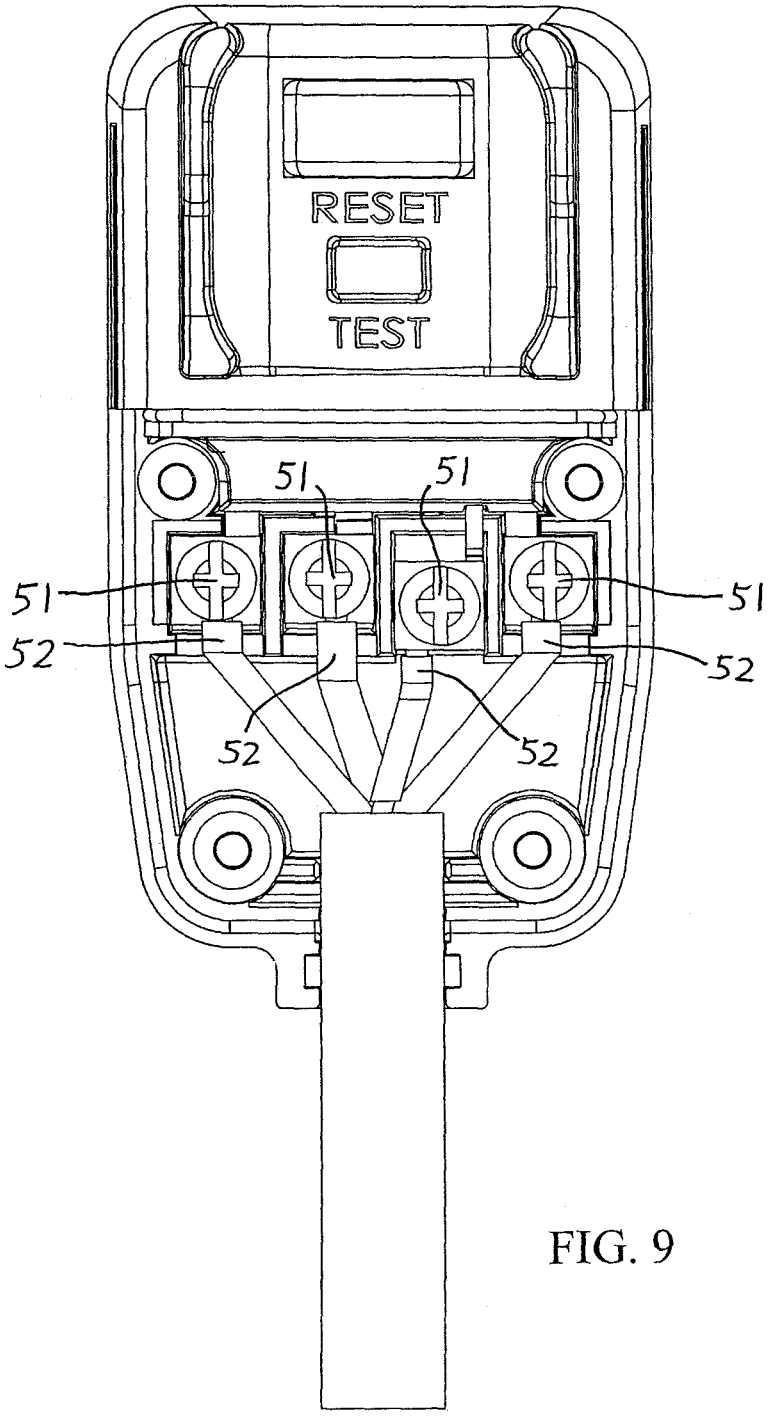
FIG. 9 is a diagram showing an electric plug with detachable connect terminals according to another embodiment of the present invention, which uses screws as the detachable connection means.
Figure 10:
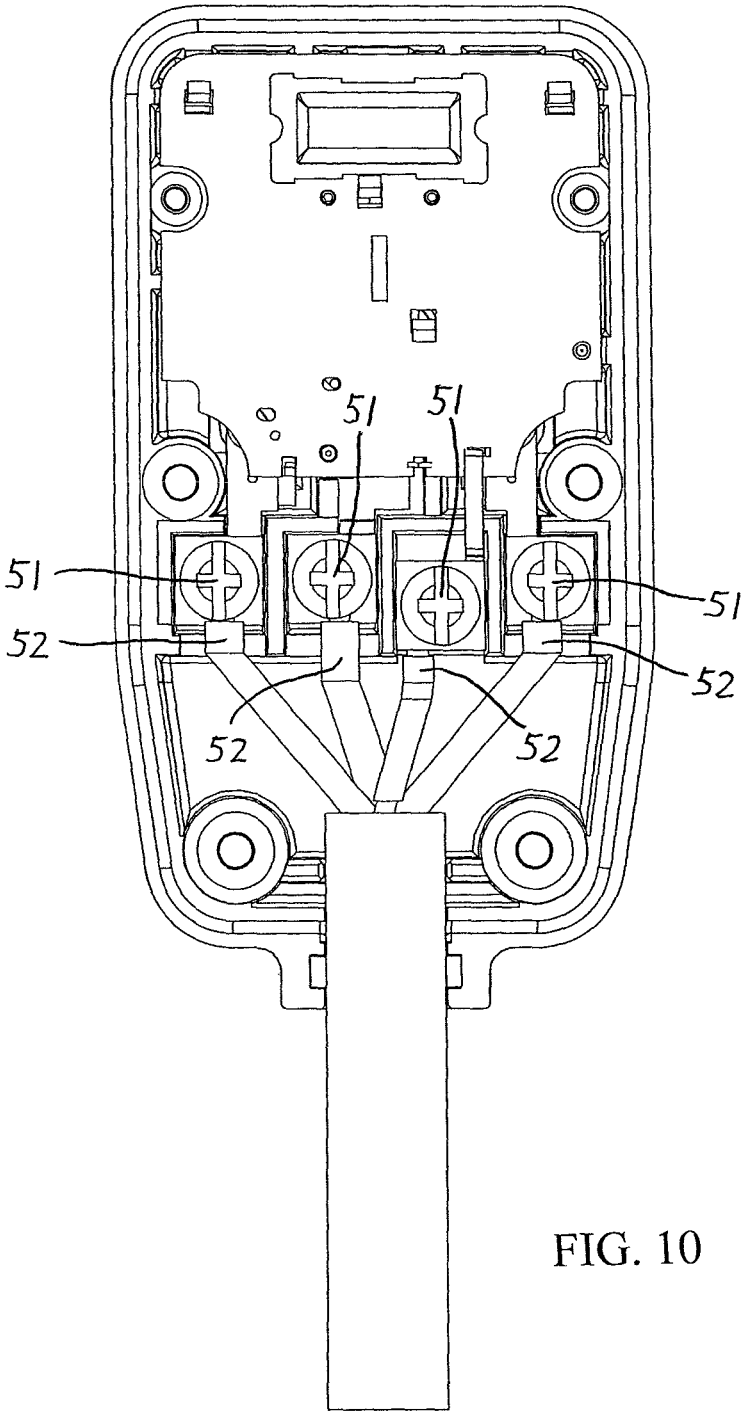
FIG. 10 is a similar view the electric plug in FIG. 9 with a cover being removed.
Figure 11:
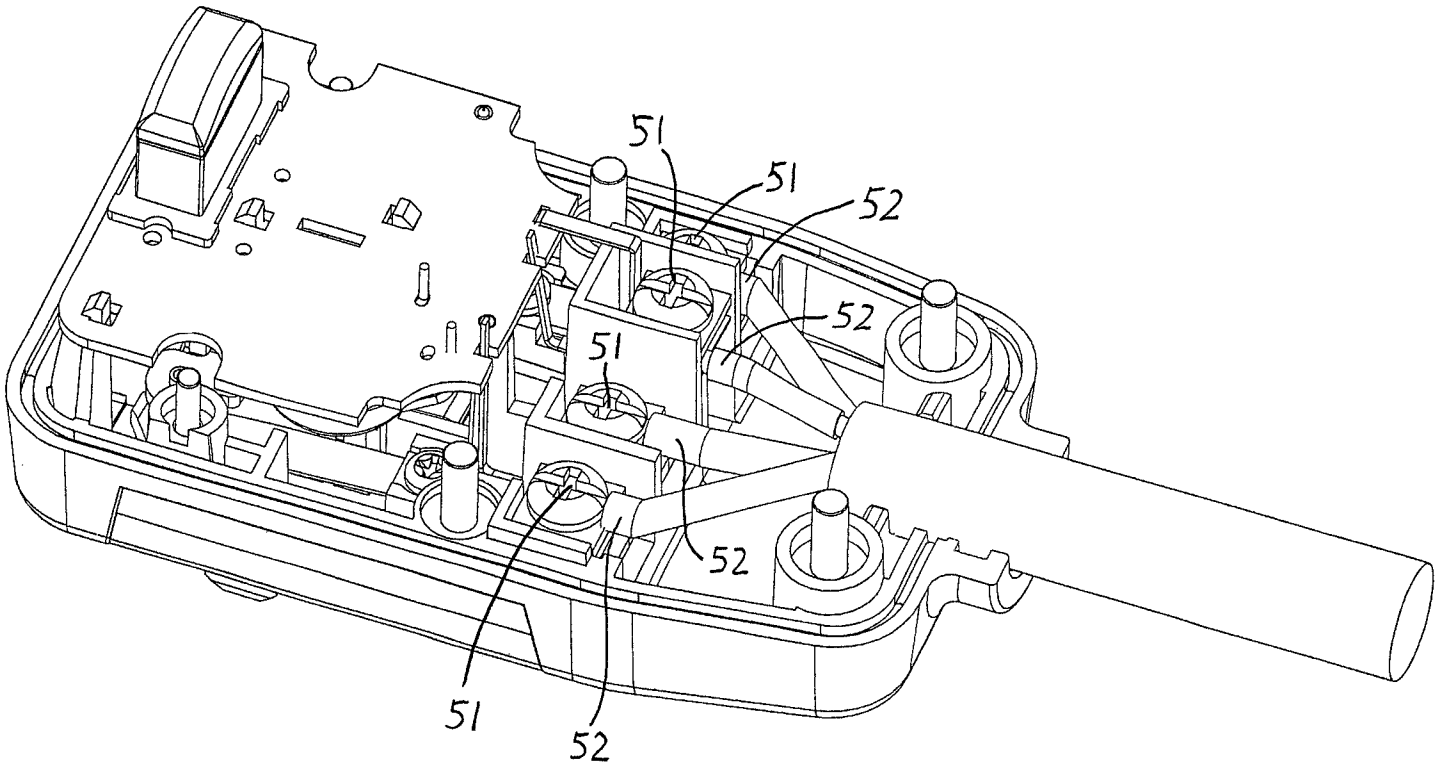
FIG. 11 is a perspective view of the electric plug shown in FIG. 10.

As shown in FIGS. 9, 10 and 11, in addition to the above described quick detachable connection terminals, terminal screws can be used as means of the detachable connection means in practicing the present invention. When terminal screws are used, the first connector is a screw assembly 51, which may comprise a metal contact plate fixed on the block, a washer and a screw, where the screw reversibly fastens the washer to the metal contact plate and between the washer and the metal contact plate is the wire (which constitutes the second connector 52) from the power cord. It is understood that terminal screws may come in various styles but they are conventional. Because terminal screws are very basic prior art components and their use are very familiar to people of ordinary skill in the art. Thus, it is understood that more detailed description of the terminal screws is unnecessary. Furthermore, a person of ordinary skill in the art may also find other detachable connection/fasten means suitable to practice the present invention under particular situations. Thus, it is understood that the two types of detachable connection methods provided herein are examples only, not a limitation to the present invention.

In a conventional electric plug, the conductive wires of the power cord are fixedly connected to the terminals inside the end block of the electric plug by soldering. The end block of the electric plug cannot be detached from the wires. If either the wires or the end block of the electric plug is damaged, the entire product will likely have to be discarded. This is a waste of material and resources.

In an electric plug with the detachable connect terminals of the present invention, the end block of the electric plug is detachable from the wires. When the end block of the electric plug or the wires need to be changed or replaced when damaged, one can easily detach the end block of the electric plug from the wires by using simple tools or even bare hands. This can substantially increase the life span of an electric plug.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An electric plug, comprising an end block and a power cord, said end block comprising a plurality of first connectors and said power cord comprising a plurality of second connectors which are corresponding to said first connectors and detachably connected thereto, wherein said first connectors and second connectors are electrically conductive, wherein at least one of said first connectors is a metal plate connected to a prong mounted on said end block, and at least one of said second connectors is a metal clip which is frictionally retained with said metal plate upon press-fitted therein, wherein said metal clip comprises:

a proximal portion comprising first and second arms, said first arm being curled up to form a first grip for gripping an insulated end of a second bundle of conductive wires of said power cord, said second arm being curled up to form a second grip for gripping and electrically coupling to a bared conductive end of said second bundle of conductive wires of said power cord; and a distal portion comprising a base with first and second tabs extending oppositely therefrom and curled up over said base to form a receptacle for frictionally retaining therein said metal plate, and wherein a free end of said second arm is provided with a finger such that, when said second arm is curled up, said finger is inserted through an aperture formed on said proximal portion of said metal clip and bent over a lower surface thereof.

2. The electric plug as claimed in claim 1, wherein one or more first connectors are connected to said second connectors by press-fitting and are retained therewith by friction.

3. The electric plug as claimed in claim 1, wherein one of said first connectors is an electric contact formed on a circuit board inside said end block, and one of said second connectors is a flexible metal leaf spring which is urged by a spring force against said electric contact on said circuit board upon coming into connection with said electric contact.

4. The electric plug as claimed in claim 3, wherein said circuit board comprises a leakage current detection interrupter circuit.

5. The electric plug of claim 1, wherein said first connector is a terminal screw assembly and said second connector is a conductive wire of said power cord.

6. The electric plug as claimed in claim 1, further comprising three metal plates connected respectively to three prongs mounted on said end block, and three metal clips connected to neutral, live and earth conductive wires of said power cord respectively.

7. The electric plug as claimed in claim 3, wherein said metal leaf spring has a vertical portion comprising a slit for frictionally holding therein an end of a first bundle of conductive wires of said power cord, and a horizontal portion having an end adapted to urge against said electric contact on said circuit board.

8. The electric plug as claimed in claim 7, wherein said slit has a closed end, a flared open end and an intermediate section, and said intermediate section is tapering towards said flared open end.

9. The electric plug as claimed in claim 7, wherein said vertical portion of said metal leaf spring comprises at least one pair of projections formed on two opposite sides thereof and frictionally engaged with two opposite inner sides of a slot formed on said end block.

10. The electric plug of claim 5, wherein said terminal screw assembly comprises a screw, a washer and a contact plate.

11. The electric plug as claimed in claim 1, wherein said first and second tabs each curled up into an inverted U-shape in cross section and forming two edges facing said base for frictionally engagement with said metal plate when it is inserted into said receptacle.

12. The electric plug as claimed in claim 1, wherein said proximal portion of said metal clip is formed with a pair of outwardly bending lugs for holding two opposite sides of said bent over finger respectively.

* * * * *